US006892699B2

(12) United States Patent
Urushiwara

(10) Patent No.: US 6,892,699 B2
(45) Date of Patent: May 17, 2005

(54) THROTTLE BODY AND AIR INTAKE EQUIPMENT FOR INTERNAL COMBUSTION ENGINE

(75) Inventor: Noriyoshi Urushiwara, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/720,482

(22) Filed: Nov. 25, 2003

(65) Prior Publication Data

US 2004/0154588 A1 Aug. 12, 2004

(30) Foreign Application Priority Data

Nov. 25, 2002 (JP) ..... 2002-340232

(51) Int. Cl.[7] ..... F02D 9/10
(52) U.S. Cl. ..... 123/337; 123/399; 73/118.2
(58) Field of Search ..... 123/337, 399, 123/361; 73/118.2

(56) References Cited

U.S. PATENT DOCUMENTS

| | | | | | |
|---|---|---|---|---|---|
| 4,304,128 | A | * | 12/1981 | Hafner et al. | 73/204.22 |
| 4,400,974 | A | * | 8/1983 | Nishimura et al. | 73/118.1 |
| 4,887,577 | A | * | 12/1989 | Arai et al. | 123/494 |
| 5,186,044 | A | * | 2/1993 | Igarashi et al. | 73/118.2 |
| 5,713,322 | A | * | 2/1998 | Mausner et al. | 123/184.21 |
| 5,988,119 | A | * | 11/1999 | Trublowski et al. | 123/41.31 |
| 6,067,958 | A | * | 5/2000 | Kamimura et al. | 123/337 |
| 6,427,668 | B1 | * | 8/2002 | Igarashi et al. | 123/494 |
| 6,494,186 | B1 | * | 12/2002 | Wakerman | 123/479 |
| 6,497,245 | B1 | * | 12/2002 | Torii | 137/315.11 |
| 6,510,735 | B2 | * | 1/2003 | Igarashi et al. | 73/204.22 |
| 6,578,414 | B2 | * | 6/2003 | Kohmura et al. | 73/202 |
| 6,622,555 | B2 | * | 9/2003 | Straight et al. | 73/202.5 |
| 6,681,742 | B1 | * | 1/2004 | Hirayama et al. | 123/399 |
| 6,725,833 | B1 | * | 4/2004 | Irihune et al. | 123/399 |
| 2001/0013331 | A1 | * | 8/2001 | Kimimura et al. | 123/337 |
| 2003/0209229 | A1 | * | 11/2003 | Kamimura et al. | 123/399 |
| 2004/0069061 | A1 | * | 4/2004 | Watanabe et al. | 73/204.26 |

FOREIGN PATENT DOCUMENTS

| | | | | |
|---|---|---|---|---|
| JP | 2000-130187 | | 5/2000 | F02D/9/00 |
| JP | 49678 | * | 2/2003 | F02D/41/00 |
| JP | 176547 | * | 6/2004 | F02D/9/10 |

* cited by examiner

*Primary Examiner*—Hai Huynh
(74) *Attorney, Agent, or Firm*—Crowell & Moring LLP

(57) ABSTRACT

A throttle body for an internal combustion engine includes an airflow sensor for measuring the flow rate of air passing through a throttle bore, a throttle position sensor for measuring the opening of a throttle valve in the throttle bore, and an engine control unit for controlling the engine. The engine control unit is secured to a base which is any other member than the body containing the throttle bore, and has pins which are electrically connected to at least any of a motor for driving the throttle valve, the airflow sensor, and the throttle position sensor.

13 Claims, 8 Drawing Sheets

THROTTLE BODY AND AIR INTAKE EQUIPMENT FOR INTERNAL COMBUSTION ENGINE

BACKGROUND OF THE INVENTION

The present invention relates to a throttle body and an air intake equipment for an internal combustion engine.

A prior art (for example Japanese Application Patent Laid-Open Publication No. 2000-130187) discloses an engine intake controlling unit comprising a first circuit board containing an electronic control unit which is provided on the cover of the hermetical casing, a second circuit board which is provided on the throttle body opposite to said first circuit board in the hermetical casing, a wiring section connected to sensors on said second printed board, a first coupler which is provided on the first circuit board and connected to the engine control unit, and a second coupler which is provided on the second circuit board and connected to said wiring section, wherein said first and second coupler are coupled with each other.

In the prior art, the control circuit board is fixed to the cover section attached the throttle body. For example the cover is attached by a heat hardening resin with heat processing. As the cover comparatively big and its heat capacity is high, a big heating facility is required to heat it up for assembly. This reduces the workability of the throttle body.

SUMMARY OF THE INVENTION

An object of this invention is to provide a throttle body and an air intake equipment for an internal combustion engine that can be assembled more easily.

To solve the above problem, this invention provides a throttle body for an internal combustion engine comprising: an airflow sensor for measuring the flow rate of air passing through a throttle bore, a throttle position sensor for measuring the opening of a throttle valve in said throttle bore, and an engine control unit for controlling the engine, wherein an electronic circuit which is said engine control unit is provided at a base which is any other member than the body containing said throttle bore.

DETAILED DESCRIPTION OF THE INVENTION

We inventors have discussed and studied throttle bodies for internal combustion engines. Conventional throttle bodies having their circuit board on the body cover are so constructed to radiate circuit heat into the air to cool the circuits by airflow or convection.

To make this heat radiation steady and improve the assembling ability of the throttle body, we have separated its circuit units such as the control circuit board and the sensor circuit from the big throttle bore body and the throttle body cover into the small base and put the final base assembly on the high heat-capacity throttle bore unit in close contact therewith.

Similarly, in the prior art, the control circuit board is mounted on the throttle body cover which is big (and has a great heat capacity). Therefore a large heating facility (furnace) is required to assemble more throttle bodies and retain heat capacities. The circuit board is secured to the throttle body cover to radiate circuit heat into the air to cool the circuits by airflow or convection.

Further, to heat and bond the control circuit section (e.g. for wire bonding, adhesion, and heat hardening) effectively at a high efficiency, the control circuit section should be smaller and separated from the throttle body. The control circuit section is mounted on the throttle body in a later step.

This invention will be described in further detail by way of an embodiment.

(Embodiment 1)

Recently, modularization of throttle bodies has been advanced further and now a throttle valve incorporates even an engine control unit which controls fuel injection and ignition timing of an internal combustion engine in addition to a throttle position sensor for detecting the opening of a throttle, an airflow sensor for measuring the air intake, and a pressure sensor.

In designing of throttle bodies, we must consider a electrical connection structure possible to cope with increasing of various I/O signals, and a heat radiation structure possible to cope with increasing a heat generation density due to miniaturization of the circuit boards. Further, since the throttle body is a combination of mechanical parts and electrical parts, in manufacturing thereof, we must consider manufacturing steps and mechanisms possible to efficiently assemble them.

Figure 1:
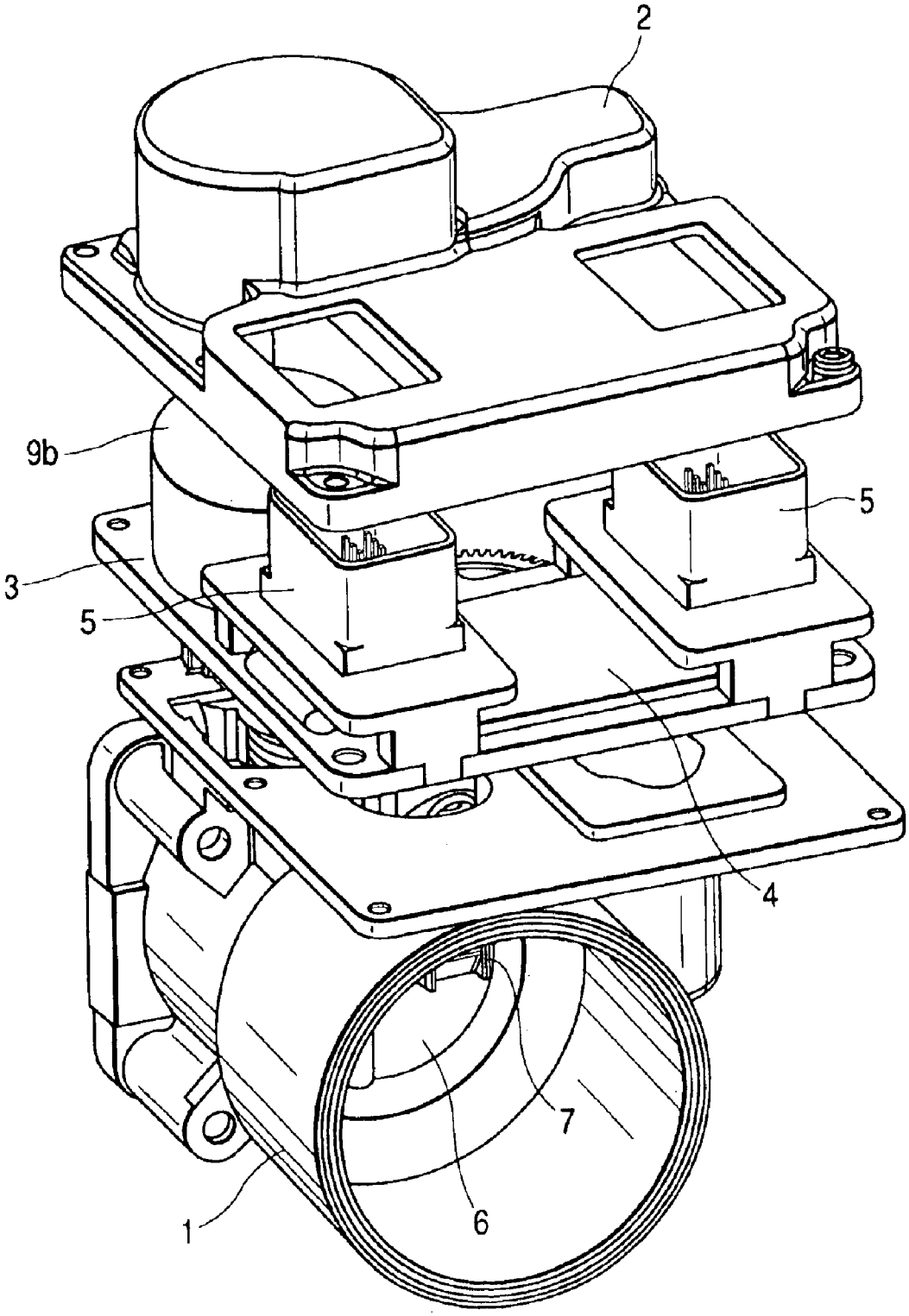
FIG. 1 shows a perspective view of a base assembly for the throttle body.

FIG. 1 shows a decomposition perspective view of the throttle body which is an embodiment of this invention.

The base 3 is equipped with an airflow sensor (hereinafter abbreviated as AFS) 7, connectors 7 for electric connection to the outside of the throttle body (hereinafter abbreviated as a connector) 5, a throttle position sensor 9*b*, and a circuit board 4. This embodiment has two connectors 5. One of the connectors 5 (the right connector in FIG. 1) is used to output and input signals required to control the engine such as a accelerator position signal etc. The other of the connectors 5 is used to output and input signals for in-car communication and AT shift position information. These connectors connect the electronic circuit on the circuit board to the outside circuit.

The circuit board 4 on the throttle body is required to be heat resistant as the throttle body is connected to the engine. Therefore, the circuit board 4 is a ceramic board and bonded to the base 3 with a thermosetting resin. The throttle position sensor 9*b* of this embodiment is provided at the base 3, and it is composed with a non-contact type sensor which detects the throttle position magnetically.

Referring to FIG. 1, the throttle body for the internal combustion engine (hereinafter abbreviated as a throttle body) is an assembly of the bore body section 1 of throttle body (namely the body of a throttle bore), the base 3, and the cover section 2 of throttle body for covering the base 3 (hereinafter called as cover section 2). They are put on top of each other at the bore body section 1 in order of the base 3, the cover section 2, and are firmly tightened by bolts (not shown in FIG. 1) set in the holes of the components 1, 3, and 2.

When the base 3 with the AFS 7 is mounted on the bore body section 1, the AFS 7 is set into bore body section 1 and positioned in the upstream side of the throttle valve 6 (in the near side of FIG. 1).

The electronic circuit section (mounted on the base 3) is composed as a subassembly of the throttle body.

Figure 5:
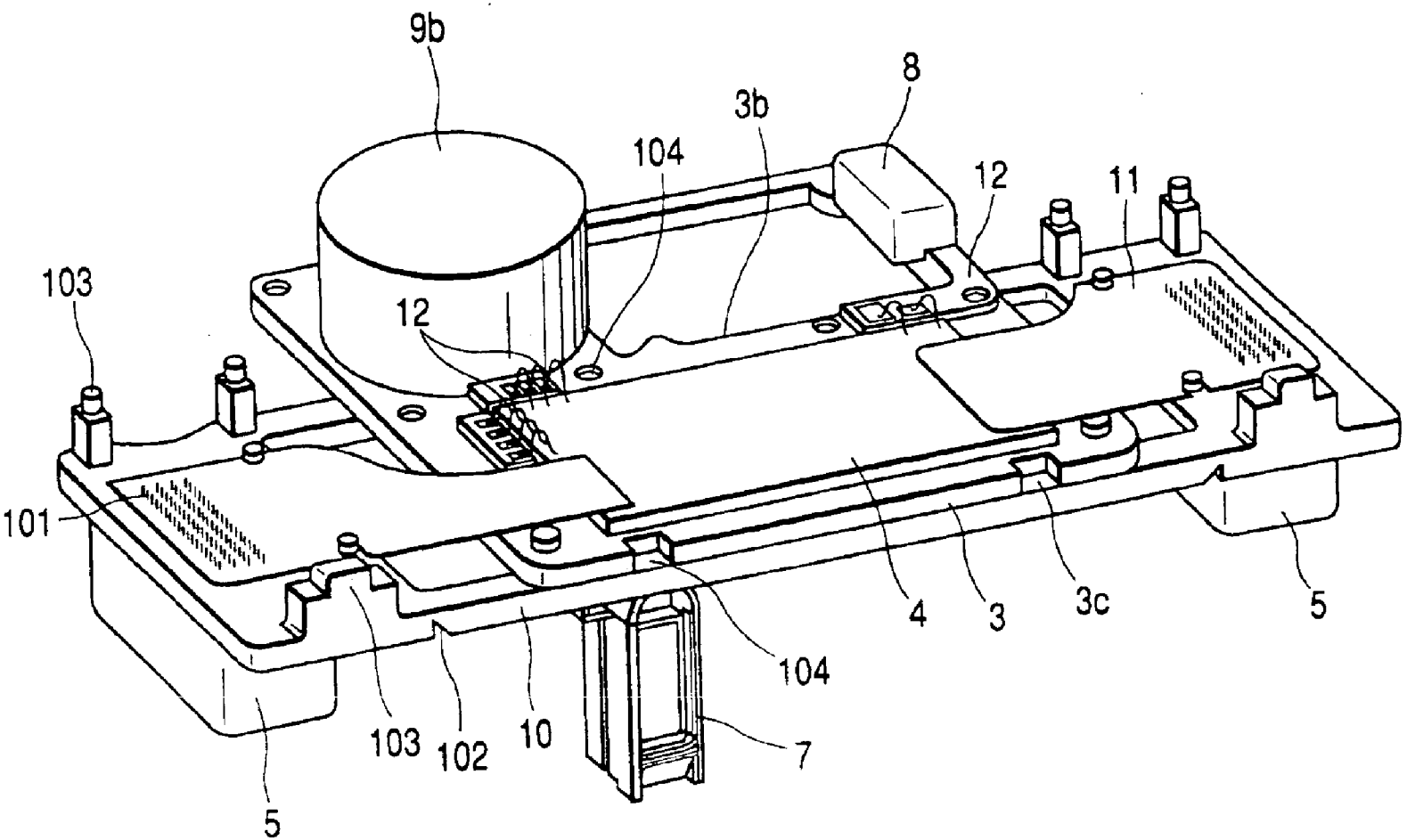
FIG. 5 shows a perspective view of the base without the electric connection section for explanation of a step of mounting the connector on the base.

Referring to FIG. 5, the electronic circuit section is described in detail below. FIG. 5 shows a perspective view of the electronic circuit section on the base 3 before attaching the connector 5. The circuit board 4 with an electronic circuit (not shown in FIG. 5) containing ICs, diodes, etc. is bonded to the base 3 with a thermosetting resin. In this embodiment, this electronic circuit for controlling the throttle valve also works as an engine control unit (ECU). Therefore, this circuit generates more heat than the electronic circuit for controlling the throttle valve only and becomes very hot.

The electric connection section 8 for the airflow sensor 7, the throttle position sensor 9*b*, and terminals of the throttle-valve driving motor 15 (shown as FIG. 7) are electrically connected to the electronic circuit respectively with bonding wires 12. The components are respectively bonded to the base 3 with adhesives.

Next, below is explained how connectors 5 are mounted on the base 3. Referring to FIG. 5, the connectors 5 are connected with the left and right ends of connector base 10 before being mounted on base 3. The connector base 10 is different member from base 3. In the mounting process of the connectors 5, the base 3 is put on the connector base 10. The circuit board 4 previously mounted on the base 3. In this state, the connector 5 faces in opposite direction of the state after its mounting (A downward state in FIG. 5). Next, the connector pin 101 of each connector 5 is connected to the electronic circuit of the board 4 with a flexible board 11. Next each connector 5 is made turn over inwards (towards the circuit board 4) around the notch 102 which is provided at the ends of connector base 10. Thereby, the positioning projection 103 of the connector fit into the positioning holes (dents) 104 on the base 3, and the connectors 5 are mounted on base 3 with positioning. After then, the connector bases 10 are removed from the base 3.

Figure 6:
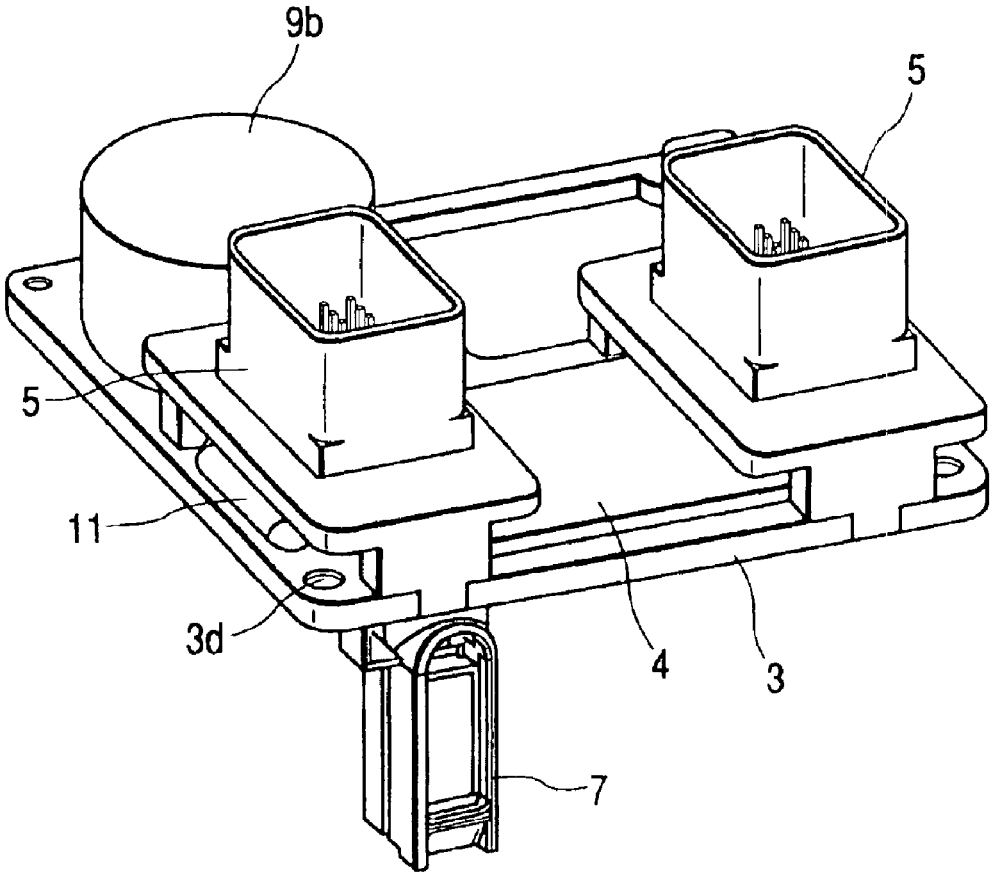
FIG. 6 shows a perspective view of the base having the connectors thereon.

With the above steps, we can easily mount the connectors 5 on same side of the base on which the circuit board 4 already exists. FIG. 6 shows a perspective view of the base having the connectors thereon. This shows that the two connectors and the circuit board 4 are densely mounted on the base 3 at the state of putting circuit board 4 between the connectors 5. As shown in FIG. 6, in this state, the base 3 already has been equipped with the airflow sensor 7 and the throttle position sensor 9*b*. Of course, the pins (terminals) of each connector 5 are electrically connected to the electronic circuit on the circuit board 4 with a flexible circuit board 11. The corner holes 3*d* of the base 3 are used to position and carry the base assembly in later assembling.

Below are explained reasons why the base and the other members are modularized in this way. Mounting various members on a smaller intermediate member (the base here) and then mounting the intermediate member on the throttle valve is much easier in assembling than mounting the members directly on the throttle valve. The electronic circuit board of this embodiment uses a heat-resistant ceramic board as it is finally assembled with the throttle body. Further, the non-circuit side of this ceramic board is bonded to the base with a thermosetting resin as it is difficult to attach the ceramic board by screws. When the heat capacity of a member to which the electronic circuit is bonded is small, the heating facility to bond the circuit board can be smaller. As the base in accordance with this embodiment has a smaller heat capacity than the member containing the throttle bore, the circuit board can be bonded to the base with a thermosetting resin in a smaller heating facility than the base is bonded to the member containing the throttle bore. Similarly, due to the low heat capacity of the base, the electronic circuit on the base can be efficiently wire-bonded to the base.

Further, this embodiment assembles various components mainly on the base, which can simplify the assembling procedure. More specifically, this can increase the working ability and efficiency and reduce the manufacturing cost of the throttle body.

Figure 7:
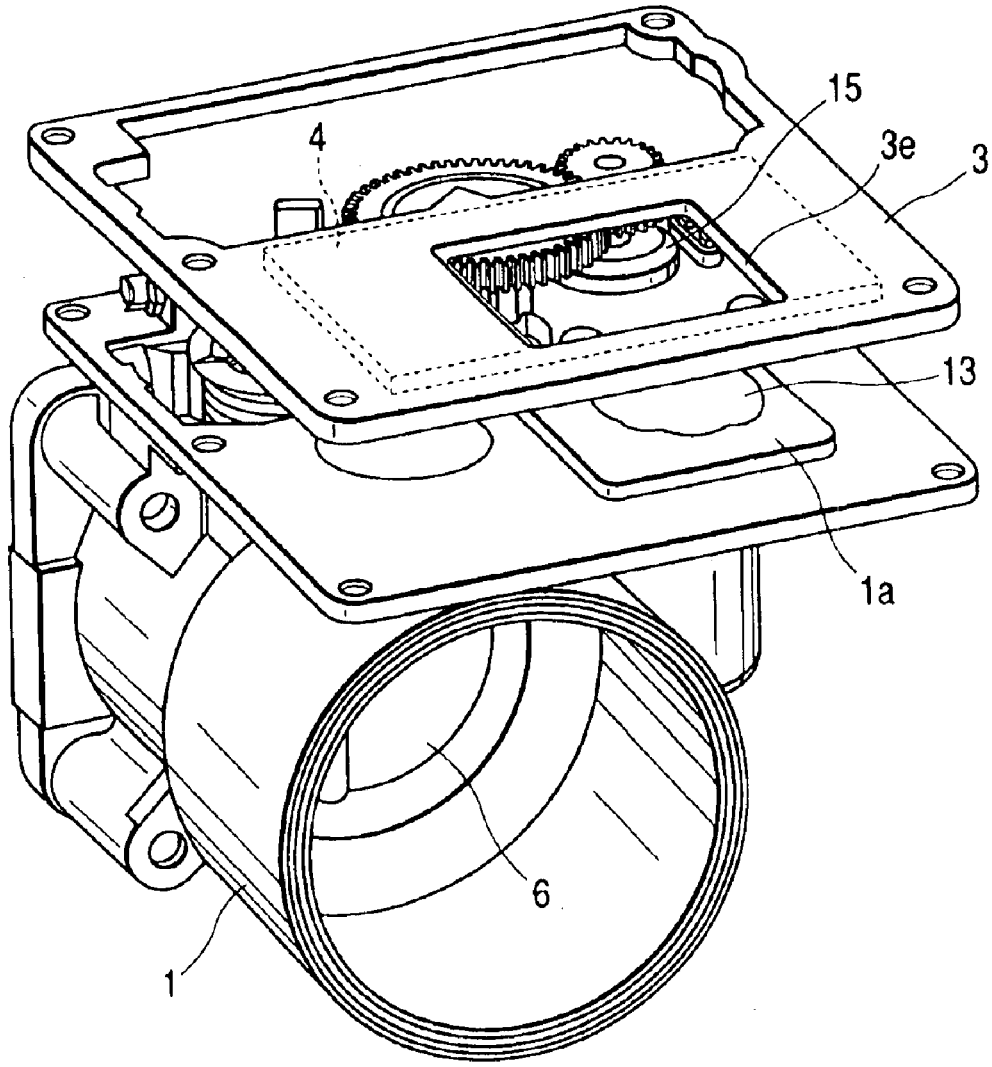
FIG. 7 shows a perspective view of the base assembly illustrating that the base has a hole under the circuit board to be mounted and that the throttle bore body has a projection to be fitted to said hole where the throttle bore body is in contact with the base.

Next, we explain how this embodiment copes with the heat generation of the electronic circuit. Referring to FIG. 7, the base 3 has an aperture 3*e* under the circuit board 4. The bore body 1 has a projection 1*a* for radiating heat of the circuit board 4. This projection 1*a* is fit into the aperture 3*e*. When the base 3 is bonded to the bore body 1, heat of the circuit board 4 can be transferred through the projection 1*a*. To increase the heat conductivity, a heat-conductive grease 13 is applied to the surface of the projection 1*a* which faces the circuit board. A heat-radiating sheet instead of the heat-conductive grease 13 can be attached to the surface. This configuration can reduce radiation role of heat through the base 3, and the base 3 can be made of resin. This can reduce the weight of the whole throttle body in comparison with a throttle body using a metallic base.

We completed a throttle body by sandwiching the above base assembly (module) between the throttle body cover 2 and the bore body 1 and tightening these together with bolts.

This embodiment can provide a throttle body equipped with an ECU and a throttle body whose ECU is fully cooled.

Figure 8:
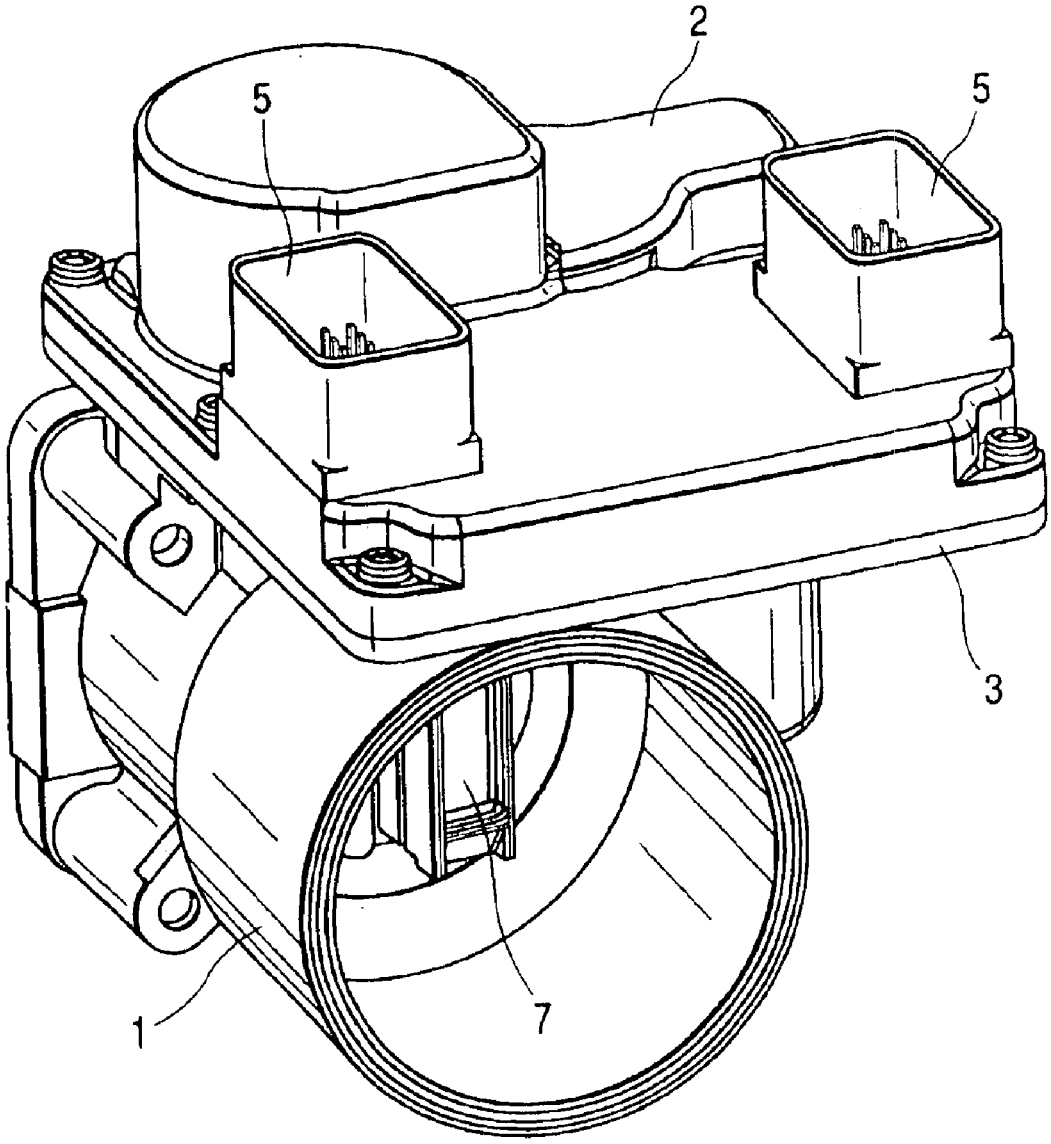
FIG. 8 shows a perspective view of the throttle body.

FIG. 8 shows a perspective view of the completed throttle body. The components of this throttle body are similar to those of FIG. 1 and their explanation is omitted.

Figure 9:
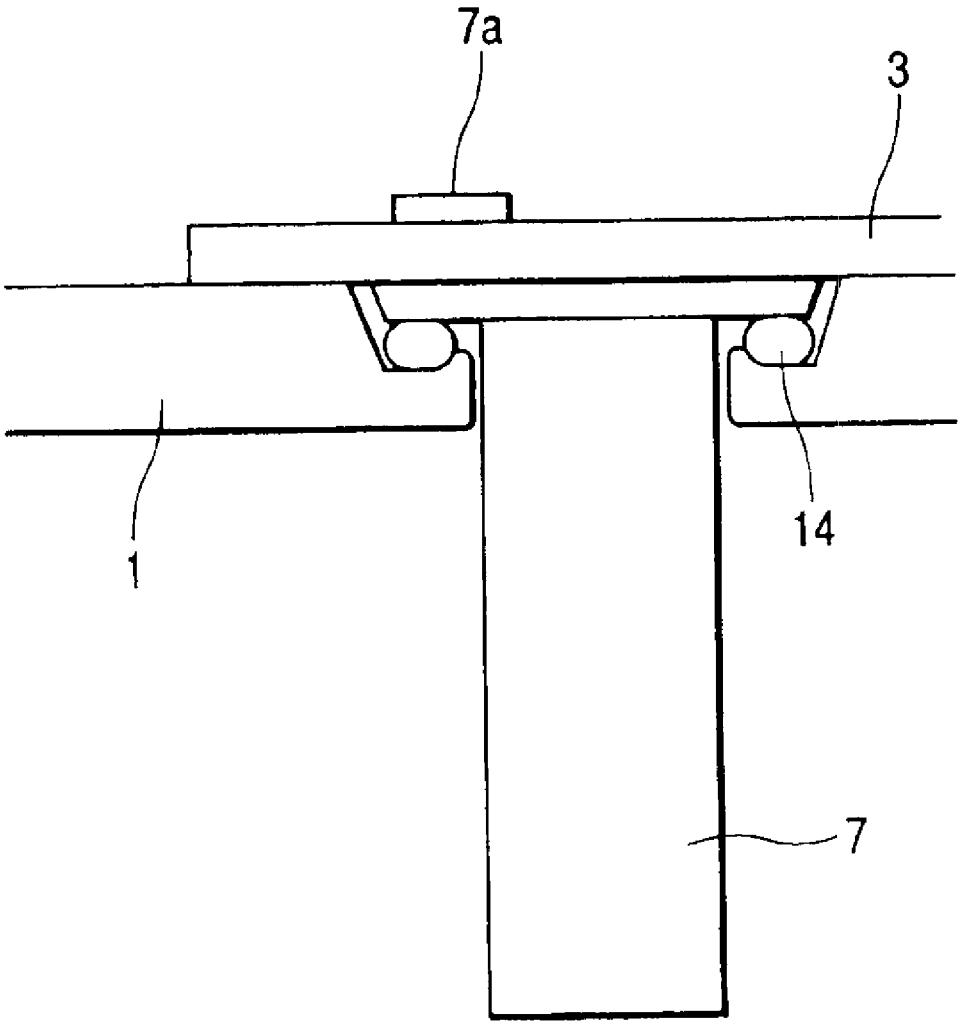
FIG. 9 shows the sealing structure of the airflow sensor.

Next, we explain how the airflow sensor is sealed at the throttle body bore. FIG. 9 shows the sealing structure of the airflow sensor 7. This embodiment requires simultaneous fitting of multiple axes such as connection to motor terminals and insertion of the airflow sensor 7 into the throttle bore body 1. Plays for fitting are provided to increase its working ability. As an O ring 14 is provided as a seal on the seat which is parallel to the surface of the base instead of the side of the airflow sensor, the hole through which the airflow sensor can be made horizontally wider so that the airflow sensor can be inserted easily.

(Embodiment 2)

Embodiment 2 is almost the same as Embodiment 1 except the following:

Embodiment 2 uses single standard airflow sensors 7 and throttle position sensors.

Figure 2:
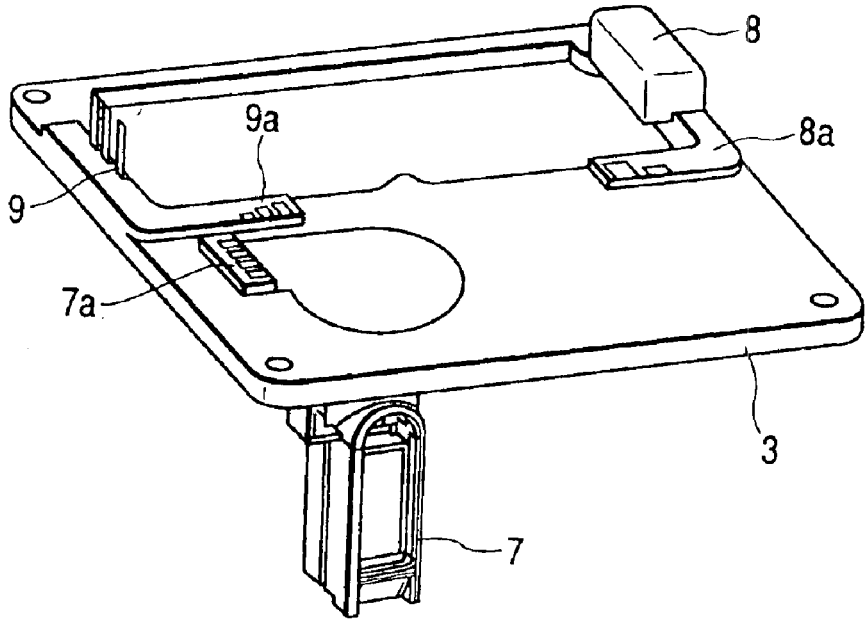
FIG. 2 shows a perspective view of an assembly of the base and the airflow sensor which further has an electric connection section for electrically connecting the throttle valve driving motor and the throttle position sensor.

FIG. 2 shows the base 3 having the airflow sensor 7 and the electrical connection section 8 for connecting the terminals of the throttle valve driving motor 15. The standard throttle position sensor 9*b* mounted on the base 3 is connected independently to the terminals 9. The airflow sensor 7 is connected to the circuit board by means of the pad 7*a* for wire bonding. The electrical connection section 8 for the terminals of the throttle valve driving motor is connected to the circuit board by means of the pad 8*a*. The terminals 9 are connected to the circuit board by means of the pad 9*a*.

(Embodiment 3)

Figure 3:
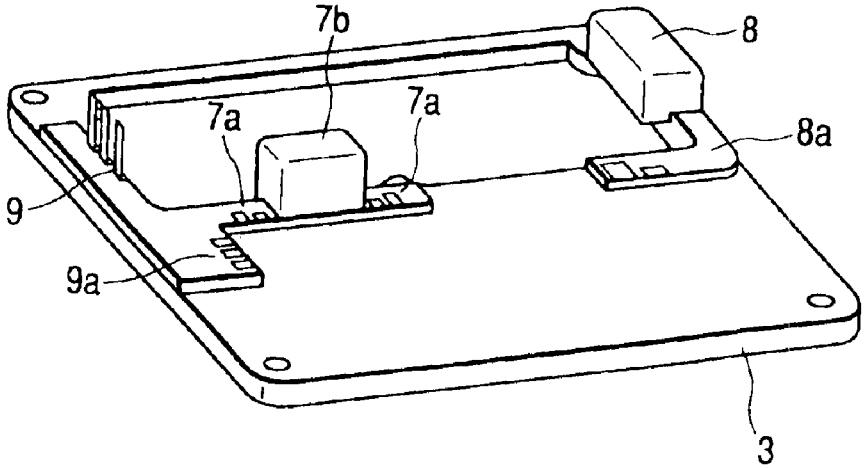
FIG. 3 shows a perspective view of an assembly of the base, the airflow sensor, and the electric connection section for connecting the throttle valve driving motor and the throttle position sensor.
Figure 4:
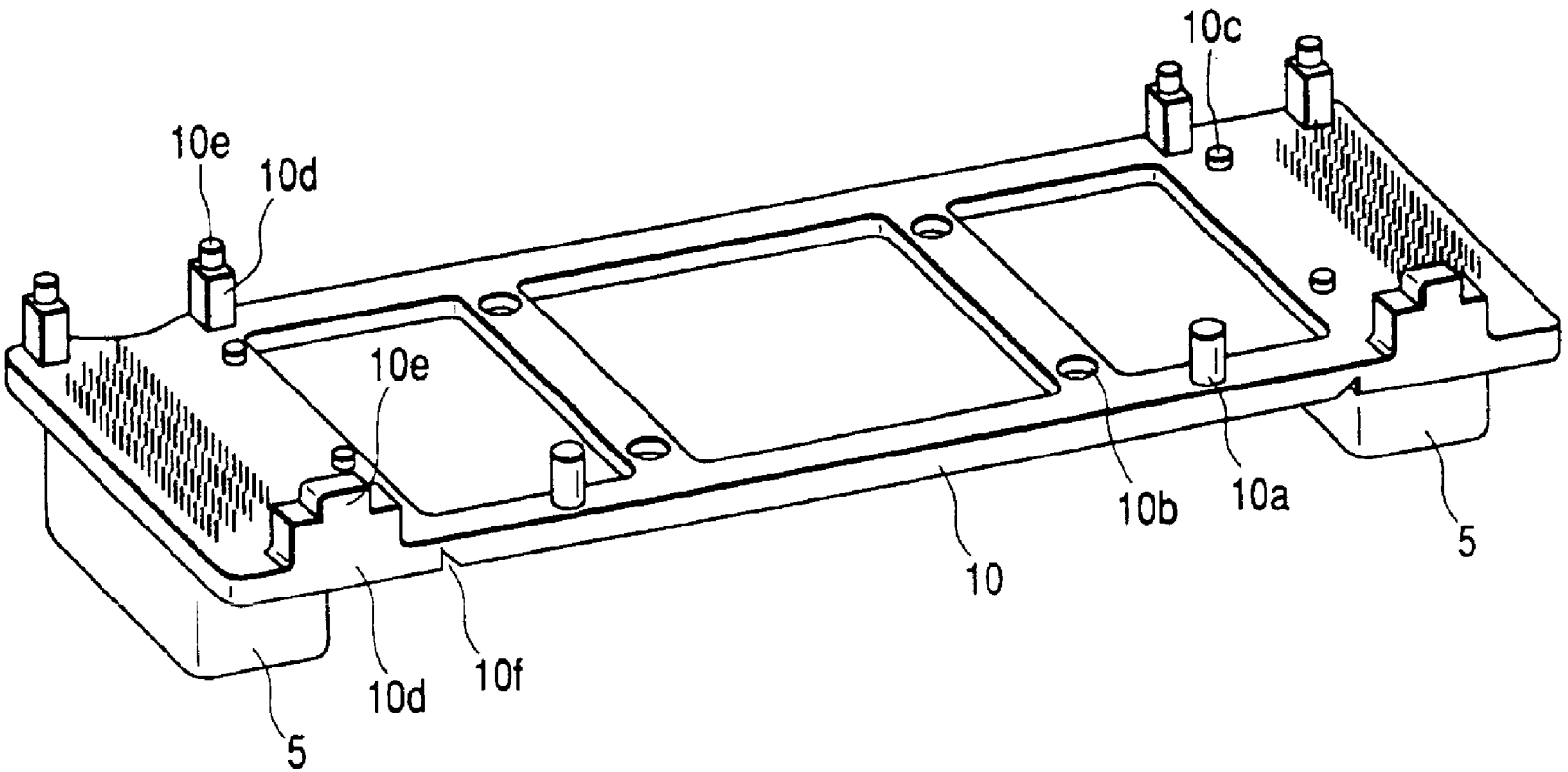
FIG. 4 shows a perspective view of the base without the electric connection section which connects the outside of the throttle body.

Embodiment 3 is almost the same as Embodiment 1 except the following:

Embodiment 3 uses single standard airflow sensors 7 and throttle position sensors. FIG. 3 shows a perspective view of an assembly of the base 3. The airflow sensor and the throttle position sensor provided at the bore body part of the throttle body. The base 3 is equipped with an electric connection section 8 for connection with the throttle valve driving motor terminals, an electric connection section 9 for connection with the throttle position sensor, and an electric connection section 7*b* for connection with the airflow sensor. The base is further equipped with the circuit board 4 and the connectors 5. Thus the completed base module contains connection sections for connecting the components, the circuit board, and the connectors. As this embodiment has an ECU on the circuit board, this embodiment can offer various throttle body products of different ECUs with an airflow sensor, a throttle valve driving motor, and a throttle position sensor as standard by just changing the base modules.

As described above, each embodiment has the base in contact with the body bore part of the throttle body. This can make the wires between the airflow sensor and the circuit board shorter than those when the ECU is provided outside the body bore. Further, this keeps the impedance of the wires low, enables faster output of the APS to the ECU, and thus improves the responsibility.

Further, in the above embodiments, the control circuit board and sensor circuits are assembled into a small base assembly which is separated from the great throttle body bore and the throttle body cover and the base assembly is finally mounted on the throttle body bore having a high heat capacity in close contact therewith. This can stabilize heat radiation of the circuit board and improve the workability of the throttle body and the ECU.

The throttle body structure made by assembling the control circuit board and sensor circuits into a small base assembly which is separated from the great throttle body bore and the throttle body cover and finally mounting the base assembly on the throttle body bore having a high heat capacity in close contact therewith can stabilize heat radiation of the circuit board and improve the workability of the throttle body.

EFFECTS OF THE INVENTION

This invention can provide a throttle body and an air intake equipment for an internal combustion engine that can be assembled more easily.

What is claimed is:

1. A throttle body for an internal combustion engine, comprising:

an airflow sensor for measuring the flow rate of air passing through a throttle bore of a bore body member of the throttle body, a throttle position sensor for measuring the opening of a throttle valve in said throttle bore, and an engine control unit for controlling the engine, wherein an electronic circuit composing said engine control unit is provided at a base which is any other member of the throttle body other than the bore body member containing said throttle bore, wherein the base is disposed on the bore body such that no electrical or mechanical components are located between the engine control unit electronic circuit and a surface of the bore body receiving the engine control unit base.

2. The throttle body for an internal combustion engine of claim 1, wherein said base has terminals which are electrically connected to at least any of a motor for driving said throttle valve, said airflow sensor, and said throttle position sensor.

3. The throttle body for an internal combustion engine of claim 1, wherein at least one of said airflow sensor and said throttle position sensor is provided at said base.

4. The for an internal combustion engine of claim 1, wherein at least one part of the base area which mounts said electronic circuit has at least one aperture, and said electronic circuit is in contact with said bore body through said aperture.

5. The throttle body for an internal combustion engine of claim 4, wherein the area on which said electronic circuit is in contact with said throttle body is greased.

6. The throttle body for an internal combustion engine of claim 4, wherein said throttle body has at least one projection which is set in said aperture.

7. The throttle body for an internal combustion engine of claim 1, wherein said throttle valve is driven by a motor provided on said bore body.

8. A throttle body for an internal combustion engine, comprising:

an airflow sensor for measuring at least one of the flow rate and the velocity of air passing through a throttle bore provided in a bore body member of the throttle body, a throttle position sensor for measuring the opening of a motor-driven throttle valve in said throttle bore, an engine control unit for controlling the engine, and a throttle body cover for covering said engine control unit, wherein an electronic circuit which comprises said engine control unit is mounted on a base member which is any other member than said bore body member containing said throttle bore; said base is disposed on said bore body such that no electrical or mechanical components are located between the engine control unit electronic circuit and a surface of the bore body receiving the engine control unit base; and said bore body, said electronic control unit base, and said throttle body cover are located in that order by tightening with screws.

9. The throttle body for an internal combustion engine of claim 8, wherein said base has connectors for connecting said electronic circuit to an external circuit.

10. The throttle body for an internal combustion engine of claim 9, wherein said connector is guided to outside of said throttle body through a hole formed at said throttle body cover from a space formed by said bore body and said throttle body cover, and connected with an outer electric section.

11. The throttle body for an internal combustion engine of claim 8, wherein said base has at least two connectors of which one connector has terminals for inputting and outputting engine controlling signals and another connector has terminals for inputting and outputting at least one of automatic transmission shift information and in-car communication.

12. The throttle body for an internal combustion engine of claim 8, wherein said connector is mounted on said base so that a projection provided at said connector may be fitted to a recess on said base, or a recess provided at said connector may be fitted to a projection on said base.

13. A throttle body for an internal combustion engine, comprising:

an airflow sensor for measuring at least one of the flow rate and the velocity of air passing through a throttle bore provided in a bore body member of the throttle body, a throttle position sensor for measuring the opening of a motor-driven throttle valve in said throttle bore, an engine control unit for controlling the engine, and a throttle cover for covering said engine control unit, wherein a part of said airflow sensor contacts with said bore body member and sealed thereon hermetically in the axial direction of airflow sensor by pressing said airflow sensor against said bore body.

* * * * *